United States Patent [19]

Hamel

[11] 4,274,352

[45] Jun. 23, 1981

[54] PORTABLE CRIMPING TOOL FOR ATTACHMENT OF SHEET METAL PLATES TO A FRAME

[76] Inventor: Emilien Hamel, 8602 Tellier St., Montreal, Canada, H1L 3A7

[21] Appl. No.: 64,568

[22] Filed: Aug. 7, 1979

Related U.S. Application Data

[63] Continuation of Ser. No. 866,769, Jan. 3, 1978, abandoned.

[51] Int. Cl.[3] ..... B21D 19/10

[52] U.S. Cl. ..... 113/57; 72/461; 81/363

[58] Field of Search ..... 72/461, 452, 458; 29/243.58; 81/363; 113/57, 54, 1 N

[56] References Cited

U.S. PATENT DOCUMENTS

| | | | |
|---|---|---|---|
| 2,471,734 | 5/1949 | Fischer | 81/363 X |
| 2,616,317 | 11/1952 | Hakkerup | 72/461 X |
| 3,180,128 | 4/1965 | Faulkner | 72/461 X |
| 3,602,032 | 8/1971 | Skintzis | 29/243.58 X |

FOREIGN PATENT DOCUMENTS

| | | | |
|---|---|---|---|
| 889616 | 1/1972 | Canada | 113/57 |

*Primary Examiner*—Mark Rosenbaum

[57] ABSTRACT

A portable crimping tool for attachment of sheet metal plates to a frame is disclosed. Said crimping tool comprises a holder having an integrally-formed pressure member at one end thereof, a force member slidably mounted on said holder and having a 90-degree finger-like element facing such pressure member and adapted to engage the edge of the sheet metal plate, and toggle lever means for operating the force member between an open position and a closed position, wherein the edge of the sheet metal plate is forced toward the pressure member by the progressively-increasing pressure exerted by the force member, said toggle lever means including an operating handle, the pivotal axis of which is adjustable longitudinally of the holder to vary the minimum distance between the finger-like element and the pressure member without changing the angle of the handle in its closed position.

1 Claim, 3 Drawing Figures

PORTABLE CRIMPING TOOL FOR ATTACHMENT OF SHEET METAL PLATES TO A FRAME

This application is a Continuing Application of Application Ser. No. 866,769, filed Jan. 3, 1978, now abandoned.

This invention relates to a portable crimping tool for attachment of sheet metal plates to a frame and, more particularly, for attachment of side panels on automobile door frames.

BACKGROUND OF THE INVENTION

Portable crimping tools for attachment of side panels to automobile doors are known. One tool of this type is disclosed, for example, in Canadian Pat. No. 889,616, issued Jan. 4, 1972. However, the crimping head of these tools generally include a pivoted hammer which requires a certain amount of working space in order to be inserted between the door and the body of a car on the edge side of the doors. With the general reduction in the size of the cars in the recent years, these tools are becoming too big and cannot be used any more on the hinge side of the doors for an increasing number of cars, so that it is necessary to remove the doors from the hinges and re-hang the doors after clamping of a new panel. This operation is time-consuming and adds up to the cost of labor which is now getting unreasonably high.

SUMMARY OF THE INVENTION

It is therefore the object of the present invention to provide a portable crimping tool which is capable of reaching otherwise inaccessible areas and which is, at the same time, light, reliable and relatively inexpensive to manufacture.

The portable crimping tool, in accordance with the invention, comprises a holder having an integrally formed pressure member at one end thereof, a force member slidably mounted on such holder and having a 90-degree finger-like element facing the pressure member and adapted to engage the edge of the sheet metal plate, and means for operating the force member between an open position and a closed position, wherein the edge of the sheet metal is forced toward the pressure member by the pressure exerted by the force member.

The force member is preferably an elongated element, having a finger-like end at 90 degrees with the axis of the elongated element. This arrangement permits each insertion of the finger-like end of the force member in the restricted space between the door and the body of the car on the hinge side of the doors. The holder is preferably a housing closed on at least three sides and enclosing the portion of the force member which is remote from the finger-like element and also a part of the mechanism operating the force member. The holder is also provided with suitable means for guiding the force member in its longitudinal movement.

The portable crimping tool is preferably operated by a handle which is pivotally mounted in the holder about a pivotal axis, and an arm having one end pivoted on the handle at a predetermined distance from such pivotal axis and its other end pivotally connected to the force member, whereby movement of the handle toward the holder will move the finger-like end of the force member toward the pressure member.

The portable crimping tool is also provided with an indexing mechanism permitting to adjust the open space between the finger-like end of the force member and the pressure member, in order to accommodate work pieces of various dimensions. This is preferably done by permitting longitudinal movement of the pivotal axis of the operating handle of the crimping tool. In a preferred embodiment of the invention, the operating handle is pivoted on the head of a threaded eye-bolt and an indexing wheel is screwed on the bolt. Such indexing wheel is mounted between guide means, preventing longitudinal movement of the indexing wheel but allowing rotational movement of the wheel, so as to permit longitudinal adjustment of the above-mentioned pivotal axis.

In order to bias the finger-like element of the crimping tool to an open position, a spring is provided between suitable abutments on the force member and the holder.

DESCRIPTION OF THE DRAWINGS

The invention will now be disclosed, by way of example, with reference to the accompanying drawings, in which.

DESCRIPTION OF A PREFERRED EMBODIMENT

Figure 1:
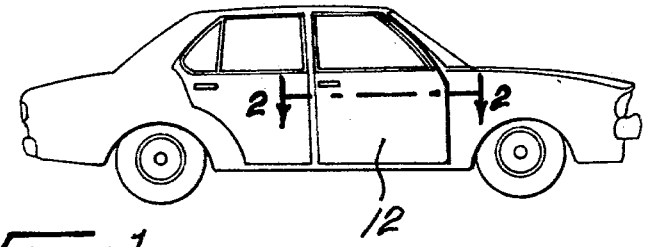
FIG. 1 is a side elevation of a car.
Figure 2:
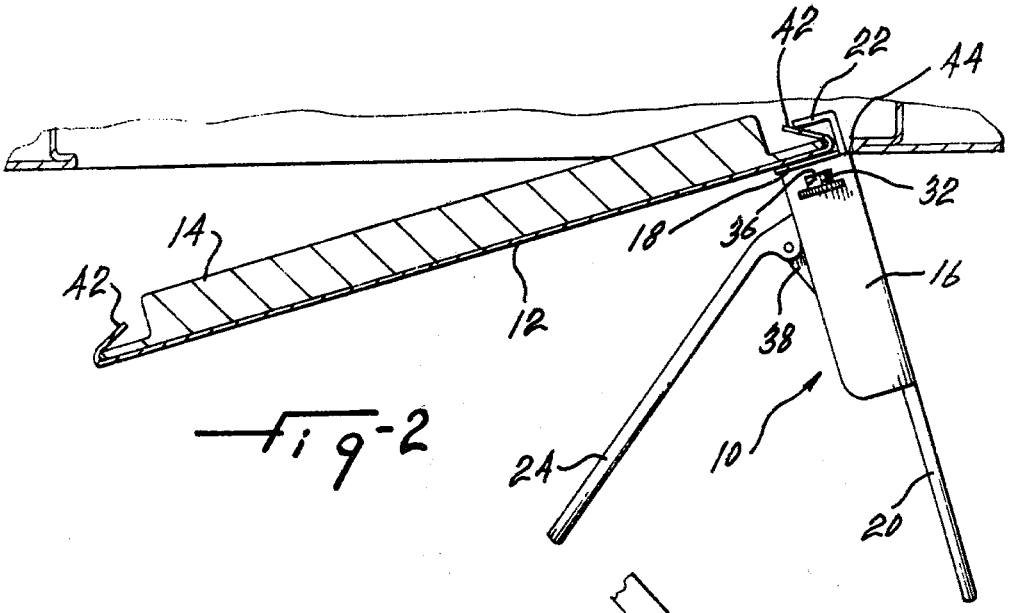
FIG. 2 is a cross-section taken on line 2—2 of FIG. 1 and shows the portable crimping tool in accordance with the invention in use in applying a side panel on a door.

Referring to FIGS. 1 and 2, there is shown a preferred embodiment of a portable crimping tool 10 in accordance with the invention, used for applying panels 12 on door frames 14 while the door is on the car.

Figure 3:
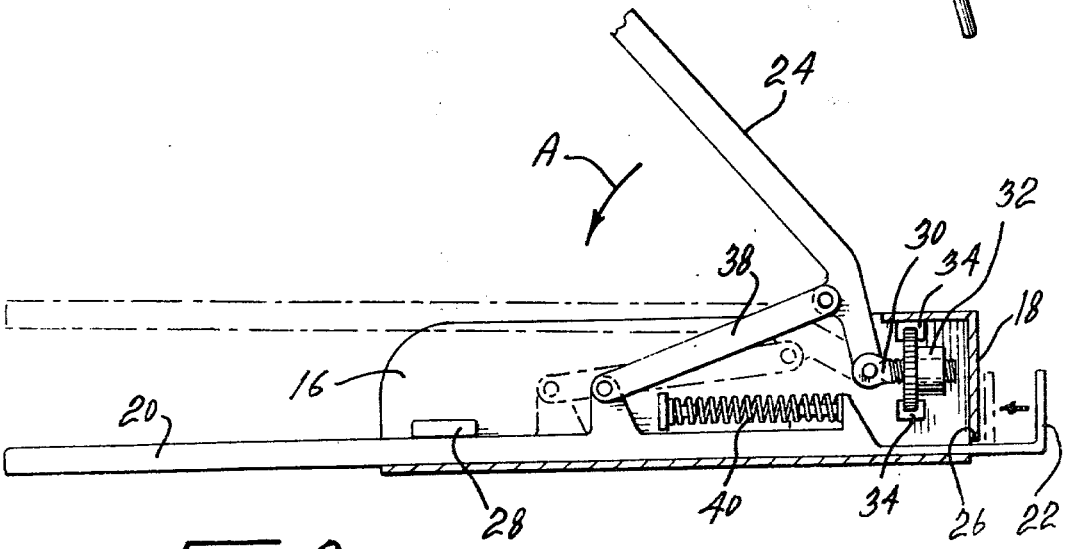
FIG. 3 illustrates a longitudinal section view of the tool in accordance with the invention.

Referring to FIGS. 2 and 3, the crimping tool 10 comprises an elongated holder 16 having an integrally-formed pressure member 18 at one end. A force member, in the form of an elongated element 20, having a finger-like forward end 22 at 90 degrees, is slidably mounted in the holder by means of a handle 24. The holder 16 is a housing closed on three sides. The side, which is open permits partial insertion of the handle mechanism in the housing. A slot 26 is provided in the holder for passing the front end of the force member 20, whereas the middle portion of the force member is guided by guide blocks 28. The back portion of the force member 20 protrudes from the back end of holder 16. It is to be understood, however, that other types of holders are also envisaged.

The handle 24 is pivoted at its inner end on the head of an eye-bolt 30, which is located adjacent the front end of holder 16 and threadably engaged by an indexing wheel 32. Indexing wheel 32 is rotatably mounted in the holder by means of guide blocks 34, which prevent longitudinal movement of the indexing wheel but allow rotational movement thereof to adjust the longitudinal position of the pivotal axis of the handle 24 for a purpose to be disclosed later. A suitable window 36 is provided in the side of the holder for giving access to the indexing wheel. An arm 38 is pivoted at its front end on handle 24 at a point which is nearer the inner end than the outer end of handle 24, and such arm is pivotally attached at its rear end to the force member 20 at a point spaced rearwardly from the pivotal connection of said handle 24 to the eye-bolt 30. Handle 24 and arm 38 form a toggle lever system.

It will be clearly seen that pivoting of handle 24 in the direction of arrow A will cause movement of the finger-like element 22 of the force member toward the pressure member 18. When handle 24 reaches a closed position nearly parallel to, and co-extensive with, the force member 20, as shown in dotted line in FIG. 3, the pivotal connection of handle 24 and the two pivotal connections of arm 38 are nearly aligned. A spring 40 is provided between suitable abutments on the force member 20 and holder 16 for biasing the crimping tool to an open position.

The above-disclosed crimping tool operates as follows:

When a panel on a door is to be replaced, the whole panel is removed and a new panel, provided with lips 42, is installed without having to remove the door from its hinges. The finger-like end 22 of the force member 20 is easily inserted in the small space 44 (FIG. 2) between the door and the car frame when the door is partly open. The handle 24 is operated from its open position in which it extends at an angle to the holder towards its closed position in which the handle is nearly parallel to the force member 20, to thereby pull the finger-like element 22 of the force member 20 toward the pressure member 18. It will be noted that a constant closing force exerted on handle 24 produces through the toggle lever system increasing clamping pressure of element 22, resulting in perfect clamping of the metal sheet around the door frame. The distance between the finger-like end 22 of the force member and the pressure member 18 may be adjusted, as required, by means of indexing wheel 32. This adjustment varies the minimum distance between end 22 and member 18 without changing the angle of handle 24 in its closed position.

Although the invention has been disclosed with reference to a preferred embodiment, it is to be understood that various modifications of such embodiment are also covered. For example, the finger-like element of the force member may take various shapes. The holder may also take various forms provided that it can be easily hand-held and that it adequately encloses the end of the force member remote from the finger-like element and the mechanism operating the force member, so as to permit safe operation of the crimping tool by the operator. Various types of indexing mechanism permitting adjustment of the open space between the finger-like element of the force member and the pressure member are also envisaged.

What I claim is:

1. A portable manually operated crimping tool for attachment of a sheet metal plate to a frame comprising:

(a) an elongated housing of U-shaped cross-section having a forward end and a rear end and formed of a bottom wall and spaced side walls and having an integrally-formed pressure member closing the forward end thereof, the rear end of said housing being open;

(b) an elongated force member having a front portion slidably mounted and guided along the bottom wall of said housing longitudinally of the latter, said elongated force member having a front end carrying an integral 90-degree finger-like element located outside the forward end of said housing, facing said pressure member and adapted to engage the edge of the sheet metal plate inserted between said pressure member and said finger like element, said force member having a back portion protruding from the rear end of said housing and of a length such as to be adapted to be grasped by an operator's hand;

(c) means for operating said force member between an open position and a closed position, wherein the edge of the sheet metal plate is forced toward the pressure member by the pressure exerted by the force member, said means for operating said force member comprising an indexing wheel rotatably mounted in opposite slots made in the side walls of said housing rearwardly of and close to said pressure member, a threaded eye bolt screwed into said indexing wheel, whereby rotation of said indexing wheel relative to said housing adjusts the position of said eye bolt longitudinally of said housing, a manually-operated handle pivotally connected to said eye bolt at its inner end and pivotable between said side walls toward and away from said back portion of said force member, between a closed position corresponding to the closed position of said force member and in which said handle is substantially parallel to and co-extensive with said force member, and an open position corresponding to the open position of said force member and in which said handle makes an angle with said force member, an arm having a front end pivoted on said handle at a point nearer the inner end than the outer end of said handle, said arm having its rear end pivotally connected to said force member at a point rearwardly spaced from the pivotal connection of said handle to said eye bolt, said handle and said arm forming a toggle lever system; and (d) compression spring means disposed between and interconnecting said force member and said housing for biasing said force member to its open position.

* * * * *